United States Patent [19]

Slebzak et al.

[11] Patent Number: 4,704,709

[45] Date of Patent: Nov. 3, 1987

[54] TRANSDUCER ASSEMBLY WITH EXPLOSIVE SHOCK PROTECTION

[75] Inventors: Gary R. Slebzak, Annapolis; John H. Thompson, Severna Park; George R. Douglas, Arnold, all of Md.

[73] Assignee: Westinghouse Electric Corp., Pittsburgh, Pa.

[21] Appl. No.: 754,508

[22] Filed: Jul. 12, 1985

[51] Int. Cl.[4] ..... H04R 15/00; H04R 17/00

[52] U.S. Cl. ..... 367/158; 367/162; 367/167; 367/172; 367/176

[58] Field of Search ..... 181/110, 122; 248/581, 248/601, 612, 634; 367/157, 158, 159, 160, 161, 162, 164, 165, 167, 172, 173, 176, 178; 310/325, 326

[56] References Cited

U.S. PATENT DOCUMENTS

| | | | |
|---|---|---|---|
| 2,870,521 | 1/1959 | Rudnick | 367/141 |
| 2,961,637 | 11/1960 | Camp | 367/158 |
| 3,110,825 | 11/1963 | Miller | 367/141 |
| 3,199,071 | 8/1965 | Massa | 367/157 |
| 3,200,369 | 8/1965 | Neubauer et al. | 367/141 |
| 3,243,767 | 3/1966 | Kendig et al. | 367/157 |
| 3,262,093 | 7/1966 | Junger et al. | 367/141 |
| 3,277,435 | 10/1966 | Thompson et al. | 367/157 |
| 3,320,578 | 5/1967 | Ahrens et al. | 367/141 |
| 3,328,751 | 6/1967 | Massa | 367/157 |
| 3,371,311 | 2/1968 | Cholet et al. | 367/157 X |
| 3,460,061 | 8/1969 | Massa | 367/158 |
| 3,474,403 | 10/1969 | Massa et al. | 367/157 |
| 3,487,353 | 12/1969 | Massa | 367/157 |
| 3,497,731 | 2/1970 | Straube | 367/141 |
| 3,509,522 | 4/1970 | Whitfill, Jr. | 367/141 |
| 3,512,126 | 5/1970 | Massa | 367/158 |
| 3,539,980 | 11/1970 | Massa | 367/157 |
| 3,716,828 | 2/1973 | Massa | 367/157 |
| 3,769,532 | 10/1973 | Tocquet et al. | 310/337 |
| 3,846,744 | 11/1974 | Renna, Jr. et al. | 367/159 |
| 3,860,901 | 1/1975 | Ehrlich et al. | 310/8.7 |
| 3,974,474 | 8/1976 | Izzo | 367/157 |
| 4,017,824 | 4/1977 | Fife et al. | 310/8.4 |
| 4,031,418 | 6/1977 | Cluzel et al. | 367/158 |
| 4,085,400 | 4/1978 | Cluzel et al. | 367/165 X |
| 4,151,437 | 4/1979 | Tocquet | 310/337 |
| 4,211,947 | 7/1980 | Ikeno et al. | 310/312 |
| 4,219,889 | 8/1980 | Parssinen et al. | 367/158 |
| 4,231,112 | 10/1980 | Massa | 367/158 |
| 4,364,117 | 12/1982 | Snow | 367/167 |

*Primary Examiner*—Deborah L. Kyle
*Assistant Examiner*—Brian S. Steinberger
*Attorney, Agent, or Firm*—D. Schron

[57] ABSTRACT

A Tonpilz transducer having head and tail masses with an interposed active transducer section. The transducer unit is positioned within a housing which has a shoulder portion upon which rests a snubber member which extends to a position just behind the head mass. The transducer is supported from the head mass by means of a thin fiberglass tube which extends from the rear of the head mass and engages a flange portion of the snubber member in the vicinity of the housing shoulder. The housing has a waterproof covering as does the head member with the covering of the head member being secured to the covering by means of a removable strap such that the transducer assembly may be disassembled for repair.

11 Claims, 6 Drawing Figures

TRANSDUCER ASSEMBLY WITH EXPLOSIVE SHOCK PROTECTION

BACKGROUND OF THE INVENTION

1. Field of the Invention

The invention in general relates to sonar transducers, and particularly to a transducer of the longitudinal resonator type which can be used at various depths in the ocean.

2. Description of the Prior Art

A common type of sonar transducer is the longitudinal resonator or Tonpilz type of transducer which includes a head mass for projection and/or receipt of acoustic energy, a tail mass operative as an inertial element and active transducer means interposed between, and coupled to, the head and tail masses. The active transducer means is generally composed of a stack of rings of a ceramic piezoelectric material having interposed electrodes to which electrical connections are made.

One type of sonar system utilizes a plurality of such transducer units arranged in a vertical, cylindrical array utilized for omni-directional transmission and/or reception and comprised of a series of vertical staves with each stave containing a predetermined number of the transducer units.

Each individual transducer unit of the array is contained within its own housing with the front surface of the head mass facing radially outward from the cylindrical array. If the array is utilized for a variable depth search operation, a situation may arise wherein the transduces of the array exceed a design depth limit or are subject to an explosive shock. In such situations, not only is performance degraded, but the transducer itself is subject to irreparable damage.

The present invention provides for an improved Tonpilz type transducer which can be used in an array and which is protected from damage in an over-depth or explosive shock situation.

SUMMARY OF THE INVENTION

The transducer assembly of the present invention includes a transducer unit having a radiating head mass, a reaction tail mass and an active transducer section interposed between, and coupled to, the head and tail masses. The transducer unit is positioned within a housing having a shoulder portion and a cylindrical snubber member extends from the shoulder portion to a position just behind the rear surface of the head mass. A cylindrical support tube is coaxial with the snubber and has one end contacting the rear surface of the head mass and another end bearing against the snubber member such that if the transducer assembly exceeds a design depth or if it is subject to an explosive shock, the snubber member will limit the inward travel of the head mass thus protecting the cylindrical support tube from breakage.

DESCRIPTION OF THE PREFERRED EMBODIMENT

Figure 1:
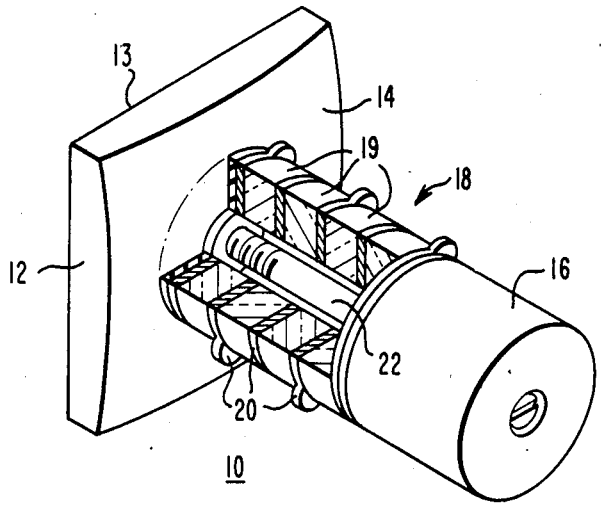
FIG. 1 PRIOR ART
FIG. 1 is a view, with a portion broken away, of a typical longitudinal resonator transducer.

The Tonpilz, or longitudinal resonator transducer unit 10 of FIG. 1 has a radiating head member 12 for transmitting and/or receiving acoustic energy in the water, and includes a front surface 13 and a rear surface 14. The transducer additionally includes a reaction or tail mass 16 as well as an active transducer section 18 interposed between, and coupled to, the head and tail masses, with the parts being arranged along a longitudinal axis A. The active transducer section may be made up of a plurality of piezoelectric rings 19 with interposed electrodes 20 for making suitable electrical connections. The various parts may be adhesively connected to one another and an axially-placed stress bolt 22 is connected to the tail mass and is threadedly engaged with the head mass.

Figure 2:
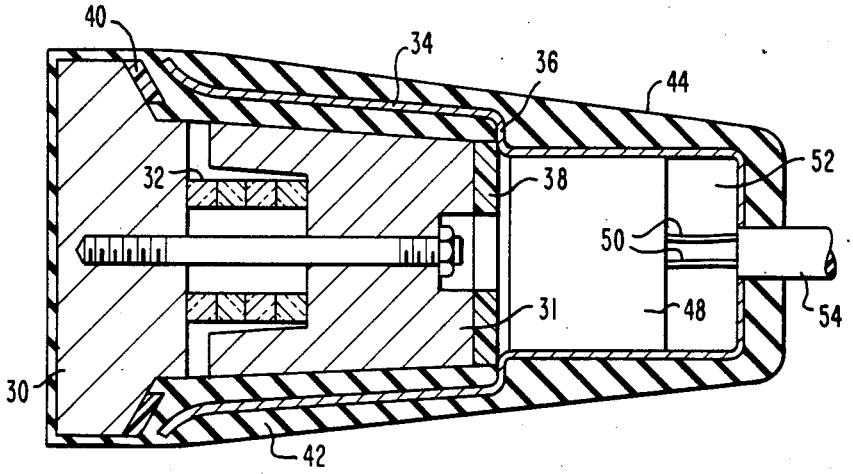
PRIOR ART FIG. 2
FIGS. 2 and 3 are axial cross-sectional views of different transducers of the prior art.

The basic Tonpilz structure is utilized in a variety of different transducer assemblies one of which is illustrated in FIG. 2. The transducer unit includes a head mass 30, a tail mass 31 and an active transducer section 32, interposed between, and coupled to, the head and tail masses. The tail mass in this design is "folded over" so as to partially surround the active transducer section 32. With this design, more tail mass can be incorporated without the need for lengthening the transducer unit.

The transducer unit is positioned within its own individual housing or container 34 having a shoulder portion 36 supporting a backing member 38 which contacts the rear of the tail mass 31. A backing member 40 is also positioned on the rear surface of head mass 30 and the transducer unit is cushioned in the housing 34 by means of an elastomeric material 42. A waterproof flexible coating 44 covers the entire assembly including the front face of the head mass 30.

Situated behind the transducer unit and within the housing 34 is a transformer 48 secured in position such as by means of an epoxy of potting compound and having electrical wiring 50 contained in a compartment 52 behind the transformer for connection to cable 54. (For simplicity, the electrical connections to the active transducer section 32 have not been illustrated.)

The transducer assembly of FIG. 2 is entirely satisfactory for operation at a relatively shallow depth. If utilized in a variable depth system, however, the increasing static hydraulic force on the head member 30 is transferred through the active transducer section 32 to the tail mass 31 thereby adding unwanted compressive stress to the active transducer section. This action completely changes the electrical and mechanical characteristics of the unit to a degree where proper operation is destroyed. Further depth increase may even result in breakage of the individual piezoelectric elements of the active transducer section, a situation which may also be brought about if the transducer is subject to an explosive shock wave in the water. Further, the encapsulated design of the transducer assembly does not lend itself to simple repair operations.

Figure 3:
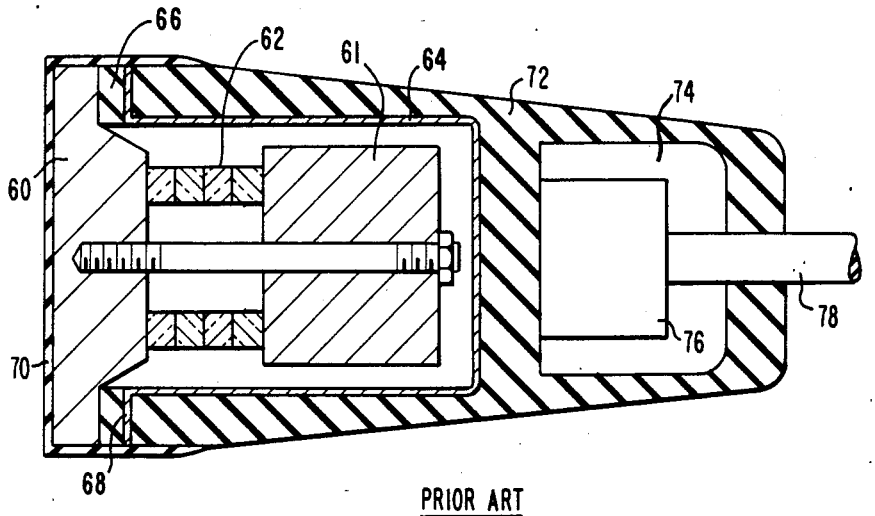
PRIOR ART FIG. 3

FIG. 3 illustrates a prior art transducer assembly which includes a transducer unit having a head mass 60, a tail mass 61 and an active transducer section 62 positioned within a container 64. The transducer unit is not supported at the tail mass but instead is supported at the head by means of a resilient support ring 66 contacting the back of head mass 60 and abutting a flange portion 68 of housing 64.

A waterproof covering 70 over the front face of head mass 60 is included as is covering 72 molded to housing 64. Covering 72 includes a separate chamber 74 in which is positioned transformer 76 electrically connected to cable 78.

Although the active transducer section 62 is not subject to additional compressive stress due to the hydrostatic pressure at deep depths, the resilient support ring 66 is non-linear with depth. That is, as the depth, and accordingly the hydrostatic pressure is increased, the resilient support ring 66 compresses and becomes stiffer and stiffer thereby detuning the transducer and severely degrading its performance.

Figure 4:
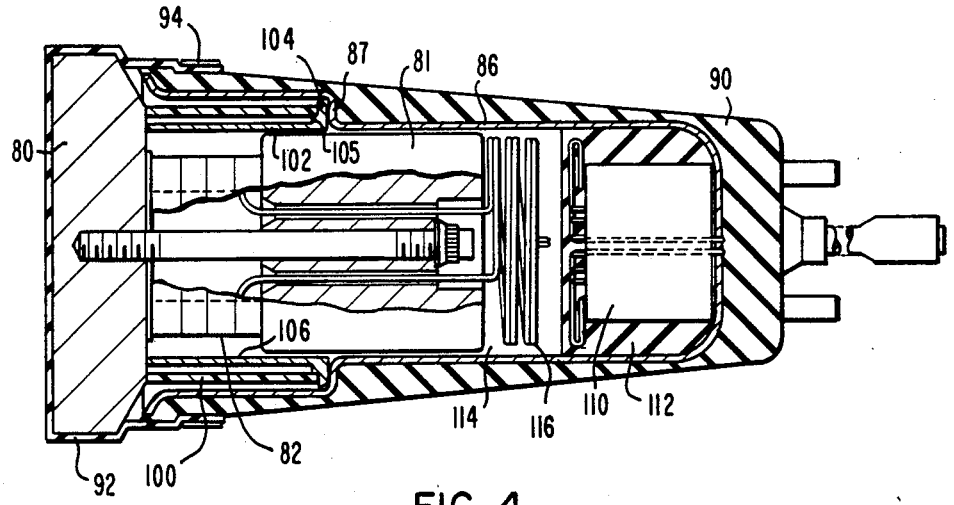
FIG. 4 is an axial cross-sectional view of a transducer in accordance with the present invention.

FIG. 4 illustrates one embodiment of the present invention and includes a transducer unit having a head mass 80, a tail mass 81 and active transducer section 82. The unit is contained in a housing 86 similar to that of FIG. 2, and which includes a shoulder portion 87 constituting a support surface.

The housing is surrounded and protected by a waterproof flexible covering 90 and a separate covering 92 extends over the front face of head mass 80, down the sides thereof and overlaps the front portion of covering 90 and is secured thereto by banding means such as removable strap 94.

A relatively thin compliant support tube 100 contacts the rear surface of head mass 80 and preferably is adhesively secured thereto. The tube extends to the shoulder portion 87 of housing 86. A tubular snubber member 102, stiff in comparison to support tube 100, is coaxial with support tube 100 and includes a flange portion 104 having a step 105 which accommodates support tube 100 and provides for positive relative placement of the two members which preferably are adhesively connected at the flange 104.

Cylindrical body 106 of the snubber member 102 extends from the shoulder portion 87 to a non-contacting position just behind the rear surface of head mass 80. Support tube 100 may be made of relatively thin inexpensive fiberglass tubing which not only structurally supports head mass 80 but which is highly compliant so as to present a relatively low impedance to the head mass during operation. If the transducer assembly should exceed its design limit capability, or if it is subject to an explosive shock, the fiberglass support tube 100 may be subject to breakage. However, with the provision of the tubular snubber member 102, rearward longitudinal movement of the head mass is limited so as to inhibit further compression of the support tube. For this purpose accordingly, snubber member 102 is preferably made of a high strength material such as steel. Snubber member 102 is sufficiently massive that the performance of the transducer is not affected by the compliance of the coupling between the snubber and the housing, a bonded joint is not required.

The interior of housing 86 additionally includes a transformer 110 positioned at the extreme end of the container and held in position by means of a potting compound 112. With this arrangement, a chamber 114 is defined between the tail mass 81 and transformer 110 to accommodate wiring 16 connecting the transformer 110 with the active transducer section 82. This construction allows for repair of the unit should it become necessary. To gain entry to the transducer components, it is only necessary to remove strap 94 and pull the transducer unit out of the casing 86. Wiring 116 in chamber 114 is of sufficient length to allow this complete removal.

Figure 6:
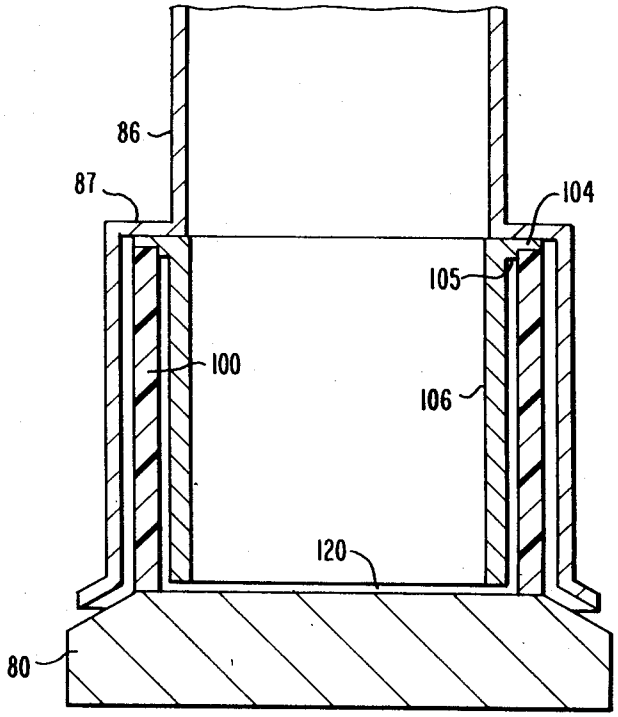
FIG. 6 is a simplified representation of a portion of the transducer illustrating certain length relationships.
Figure 5:
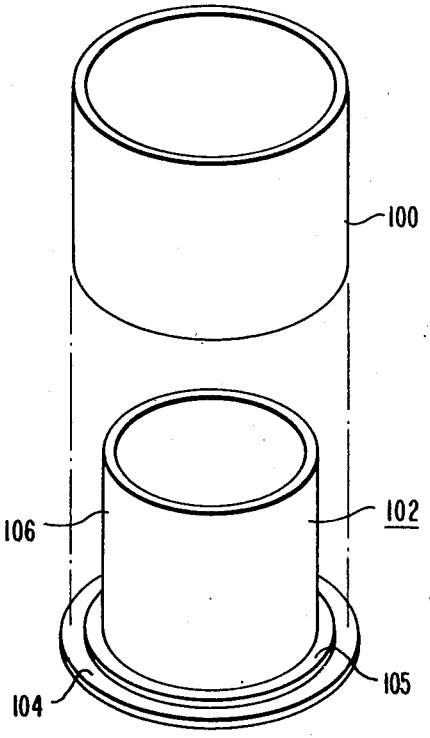
FIG. 5 is an exploded view of a portion of the transducer.

FIG. 5 illustrates an exploded view of the support/-snubber assembly while FIG. 6 shows a portion of FIG. 4 to better illustrate the positioning of the support tube and snubber member and the resulting gap 120 which defines the limit of travel of head mass 80.

We claim:

1. A transducer assembly comprising:

(A) a transducer unit including a head mass having front and rear surfaces, a tail mass and an active transducer section interposed between, and coupled to, said head and tail masses;

(B) a housing having a shoulder portion;

(C) said transducer unit being positioned within said housing with said head mass being positioned for energy transfer with an ambient water medium;

(D) a cylindrical snubber member extending from said shoulder portion of said housing to a non-contacting position just behind said rear surface of said head mass;

(E) a cylindrical support tube coaxial with said snubber member and having one end contacting said rear surface of said head mass and another end bearing against said snubber member at one end thereof;

(F) said cylindrical support tube being highly compliant so as to present a relatively low impedance to said head mass during operation; and (G) said cylindrical snubber member being stiff in comparison to said cylindrical support tube whereby if said transducer assembly is subjected to a greater than normal hydrostatic pressure tending to compress said cylindrical support tube to the breakage point, said snubber member will limit the rearward longitudinal movement of said head mass so as to inhibit further compression of said cylindrical support tube to prevent breakage thereof.

2. Apparatus according to claim 1 wherein:

(A) said one end of said cylindrical support tube is adhesively secured to said rear surface of said head mass.

3. Apparatus according to claim 2 wherein:

(A) said other end of said support tube is adhesively secured to said snubber member.

4. Apparatus according to claim 1 wherein:

(A) said snubber member includes a cylindrical side wall terminating in a flange portion;

(B) said flange portion contacts said shoulder portion of said housing.

5. Apparatus according to claim 4 wherein:

(A) said flange portion includes a step;

(B) said other end of said support tube contacts said step to maintain a coaxial alignment.

6. Apparatus according to claim 1 wherein:

(A) said cylindrical support tube is of fiberglass.

7. Apparatus according to claim 1 wherein:

(A) said snubber member is of steel.

8. Apparatus according to claim 1 wherein:

(A) said housing is encased in a waterproof covering and which includes:

(B) a separate covering extending over said front surface of said head mass and down past said rear surface to cover a portion of said waterproof covering; and (C) banding means securing said separate covering to said waterproof covering.

9. Apparatus according to claim 8 wherein:

(A) said banding means is removable so that said transducer unit maybe removed from said housing.

10. Apparatus according to claim 9 wherein:

(A) said housing has a closed end and which includes:

(B) a transformer positioned in said housing at said closed end so as to define a volume between said transformer and said tail mass;

(C) a plurality of electrical conductors connecting said transformer with said active transducer section;

(D) the major length of said conductors being stored within said volume and being of sufficient length that said transducer unit may be withdrawn from said case when said bonding means is removed.

11. A transducer assembly comprising:

(A) a transducer unit including a head mass having front and rear surfaces, a tail mass and an active transducer section interposed between and coupled to, said head and tail masses;

(B) a support surface located within a housing enclosing the transducer unit;

(C) a cylindrical snubber member extending from said support surface to a non-contacting position just behind said rear surface of said head mass; and (D) a cylindrical support tube coaxial with said snubber member and having one end contacting said rear surface of said head mass and another end bearing against said snubber member;

(E) said cylindrical support tube being highly compliant so as to present a relatively low impedance to said head mass during operation; and (F) said cylindrical snubber member being stiff in comparison to said cylindrical support tube whereby if said transducer assembly is subjected to a greater than normal hydrostatic pressure tending to compress said cylindrical support tube to the breakage point, said snubber member will limit the rearward longitudinal movement of said head mass so as to inhibit further compression of said cylindrical support tube to prevent breakage thereof.

* * * * *